US007791289B2

(12) United States Patent
Oosterbaan et al.

(10) Patent No.: US 7,791,289 B2
(45) Date of Patent: Sep. 7, 2010

(54) COLOR ADJUSTABLE LAMP

(75) Inventors: Thijs Oosterbaan, Eindhoven (NL); Bernardus Lambertus Martinus Van Bakel, Eindhoven (NL); Joseph Franciscus Raymond Eijsermans, Eindhoven (NL); Nicola Bettina Pfeffer, Eindhoven (NL); Marinus Cornelis Raas, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 900 days.

(21) Appl. No.: 11/572,229

(22) PCT Filed: Jul. 14, 2008

(86) PCT No.: PCT/IB2005/052338

§ 371 (c)(1),
(2), (4) Date: Jan. 17, 2007

(87) PCT Pub. No.: WO2006/011092

PCT Pub. Date: Feb. 2, 2006

(65) Prior Publication Data

US 2008/0094003 A1 Apr. 24, 2008

(30) Foreign Application Priority Data

Jul. 21, 2004 (EP) ..... 04103473

(51) Int. Cl.
*G05F 1/00* (2006.01)

(52) U.S. Cl. ..... 315/294; 315/362; 315/291; 315/312; 315/325

(58) Field of Classification Search ..... 315/51, 315/56, 58, 291, 294, 307, 362, 312, 324, 315/325, DIG. 4; 362/184, 192, 253
See application file for complete search history.

(56) References Cited

U.S. PATENT DOCUMENTS

| | | | | |
|---|---|---|---|---|
| 4,298,869 | A * | 11/1981 | Okuno | 345/82 |
| 5,430,356 | A * | 7/1995 | Ference et al. | 315/291 |
| 5,924,784 | A * | 7/1999 | Chliwnyj et al. | 362/234 |
| 6,323,605 | B1 | 11/2001 | Greenberg et al. | |
| 6,628,089 | B2 | 9/2003 | Suomi | |
| 6,787,999 | B2 * | 9/2004 | Stimac et al. | 315/51 |

FOREIGN PATENT DOCUMENTS

| | | | |
|---|---|---|---|
| GB | 2288903 | A | 11/1995 |
| JP | 02160362 | A | 6/1990 |
| JP | 05205881 | A | 8/1993 |
| JP | 06283277 | A | 10/1994 |
| JP | 07065965 | A | 3/1995 |
| JP | 08180978 | A | 7/1996 |
| JP | 09092486 | A | 4/1997 |

* cited by examiner

*Primary Examiner*—Haissa Philogene

(57) ABSTRACT

A color adjustable lamp may be controlled using a well-known TRIAC dimmer circuit. The color adjustable lamp comprises two or more light sources. Each light source may output light having a different color. By setting an output intensity of each light source, light having a desired color may be output. A circuit or a processing unit comprised in a lamp driving circuit may detect a set phase angle of the TRIAC dimmer circuit by determining a shape of the supplied alternating voltage. According to the determined shape, the circuit or processing unit controls a lamp driver circuit for each light source in order to control the intensity of the light output by each light source.

9 Claims, 3 Drawing Sheets

COLOR ADJUSTABLE LAMP

FIELD OF THE INVENTION

The present invention relates to a lamp and a lamp driving method and in particular to a color adjustable lamp and a method for controlling said color adjustable lamp.

BACKGROUND OF THE INVENTION

A color of light depends on a spectrum of light waves having different wavelengths present in said light. Light having only wavelengths in a band of said spectrum is perceived as a certain color, such as blue, green or red. If all wavelengths are present in the light, a perceived color of said light may be characterized by a color temperature. Light comprising a large amount of light waves with a relatively short wavelength is perceived as blue and cold light, whereas light comprising a large amount of light waves with a relatively long wavelength is perceived as red and warm light. Hereinafter, a color of light refers to any combination of visible wavelengths comprised in said light.

A person may want to adjust the color of the light emitted by a light source depending on the situation and the application. Recently lamps have been developed that may be adjusted to output light with a different color. Such lamps may be based on different technologies, for example fluorescent lamps or LED technology.

The above-mentioned known color adjustable lamps, however, are not easily installable in existing electrical installations. The known color adjustable lamps may comprise a digital interface for adjusting the color. Other known color adjustable lamps may require a lamp driving circuit, which needs additional wiring for user control. Further, common lamp bulbs are not easily replaced by such a color adjustable lamp, since they require said additional circuitry and wiring and they may have a complex user interface.

SUMMARY OF THE INVENTION

It is therefore an object of the present invention to provide a color adjustable lamp which may be used in existing electrical installations without requiring additional wiring.

The color adjustable lamp according to the present invention comprises at least two light emitting devices, i.e. light sources. A light source may be based on any kind of technology. It may for example be a Light Emitting Diode (LED), a fluorescent lamp, an incandescent lamp, or any other kind.

The at least two light sources are configured to emit light with a different color. Thus, if one of the light sources is on, the light emitted by the color adjustable lamp is identical to the light emitted by said one light source. If two or more light sources are on, the light emitted by the color adjustable lamp is a mixture of the light of said two or more light sources. Thus, the color of the emitted light may vary from the light color of one light source to the light color of one or more, possibly other light sources and any combination thereof.

The at least two light sources are controlled by a lamp driving circuit. The lamp driving circuit receives a supply voltage and converts the supply voltage to an appropriate light source supply voltage, or current, for each light source. The light source supply voltage determines the output light intensity of the light source. The appropriate light source supply voltage determines an output light intensity per light source such that a predetermined total light color is generated by the color adjustable lamp.

According to the present invention, the supply voltage is a varying supply voltage. The supply voltage may be an alternating supply voltage or it may be a varying rectified voltage. The shape of the voltage is determined by the variation of the supply voltage.

The supply voltage energizes the light sources and its shape determines the color of the light output by the lamp. Thereto, the shape of the supply voltage is determined in the lamp driving circuit and the lamp driving circuit is configured to control each light source. In accordance with the determined shape of the supply voltage, the light sources are supplied with a corresponding light source supply voltage, or current, in order to control the intensity of the output light of each light source, thereby controlling the color of the total output light of the lamp.

It is noted that according to an aspect of the present invention the shape of the supply voltage may only be used to determine which of the at least two light sources is on, outputting a maximum intensity of light, and which of the at least two light sources is off, outputting no light. Thus, in such an embodiment the color adjustable lamp may only output light with a predetermined number of possible colors.

The lamp and the lamp driving circuit may be comprised in a housing and bulb such that the lamp may replace a common light bulb. Further, the supply voltage may be a sine wave shaped alternating mains voltage and a phase angle dimmer, such as a TRIAC may set the shape of the alternating supply voltage. A TRIAC phase angle dimmer is a well-known device for dimming a light source, such as an incandescent light bulb, and its functioning is therefore not described in further detail here. Thus, the color adjustable lamp according to the present invention may replace a common light bulb and using a common light source dimmer the color of the emitted light may be adjusted without requiring any additional wiring or using a complex interface.

In an embodiment of the present invention, the lamp driving circuit comprises a ballast circuit for each light source. The ballast circuit is configured to supply the correct voltage or current to each light source depending on the kind of light source. For example, an LED needs a different kind of supply voltage than a fluorescent lamp.

A ballast control circuit generating a control signal may supply said control signal to each ballast circuit in order to control the light intensity of each light source. The ballast control circuit determines said control signal according to the shape of the supply voltage.

In particular when an alternating supply voltage may be supplied to the lamp, the lamp driving circuit may advantageously comprise a rectifier circuit for rectifying an alternating supply voltage and outputting a rectified varying supply voltage. In case a varying rectified voltage is supplied to the rectifier circuit, the output of the rectifier circuit may be identical to the supplied voltage.

If a phase angle dimmer circuit is used to set the shape of the supply voltage, the ballast control circuit may advantageously comprise a Schmitt trigger circuit for converting the varying supply voltage to a square wave voltage. In such a case, the output of the Schmitt trigger circuit is a square wave voltage having a pulse width that is determined by the phase angle of the supply voltage. The ballast control circuit may employ said square wave voltage as the lamp control signal. The lamp ballast circuit may employ the pulse width of the square wave voltage to determine the desired light intensity of the light source. For example, the light source may be on, when the square wave voltage is high, and the light source may be off when the square wave voltage is low.

In another embodiment of the present invention, the ballast control circuit comprises a processor. Said processor may receive a processor control signal, which is determined by the shape of the supply voltage. Said processor control signal may be similar to the supply voltage.

The processor control signal may be processed according to a predetermined algorithm to obtain a lamp control signal for each lamp ballast circuit. Said lamp control signals are supplied to each lamp ballast circuit, and thus control each light source. In such an embodiment, the algorithm may be such that the light color change of the lamp is not linear to the change of the phase angle. Also, in a further embodiment, not only the total light color may be adjusted, but also the total output light intensity, possibly independent from the light color, which will be explained in more detail hereinafter.

In a further embodiment, the ballast control circuit comprises a memory, in which a look-up table is stored. Further, the ballast circuit comprises said processor, which may access said memory to access said look-up table. The processor may receive said processor control signal, which is determined by the shape of the supply voltage. Based on said processor control signal, said processor may determine a ballast control signal for each ballast circuit according to the look-up table stored in said memory. The processor outputs said ballast control signal for each ballast circuit, thereby controlling the color of the light emitted by the lamp.

These and other aspects of the present invention will be apparent from and elucidated with reference to the embodiments described hereinafter.

BRIEF DESCRIPTION OF THE DRAWINGS

The annexed drawings show non-limiting exemplary embodiments, wherein.

In the drawings, identical reference numerals indicate similar components or components with a similar function.

DETAILED DESCRIPTION OF THE EMBODIMENTS

Figure 1:
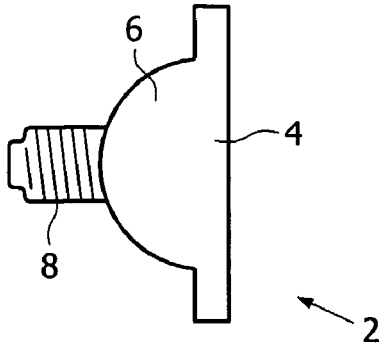
FIG. 1 schematically shows an embodiment of a color adjustable lamp according to the present invention, FIG. 2 schematically shows another embodiment of a color adjustable lamp according to the present invention.

FIG. 1 shows a side view of a lamp 2 according to the present invention. The lamp 2 comprises a light source housing 4, a lamp driving circuit housing 6 and a common lamp fitting 8.

Figure 2:
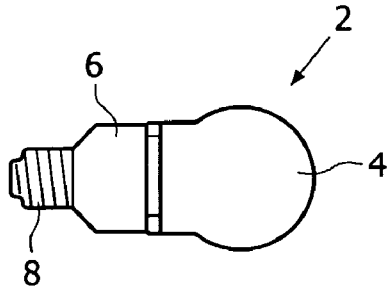

FIG. 2 shows another embodiment of a lamp 2 according to the present invention. In FIG. 2, the light source housing 4 is bulb shaped like a common incandescent lamp. The lamp driving circuit housing 6 may have any suitable form for housing a lamp driving circuit. The lamp fitting 8 is preferably a common lamp fitting, for example such as employed in common incandescent lamps.

The light source housing 4 houses two or more light sources. Each light source may be configured to output light with a different color, or a first number of light sources may be configured to output light having a first color, and a second number of light sources may be configured to output light having a second color. Thus, light of a desired color may be generated by switching one or more light sources on, and the other light sources off. Instead of switching light sources on or off, also the intensity of the light from the light sources may be varied.

In a preferred embodiment, the output light intensity of each light source may be controlled such that the lamp 2 according to the present invention may generate a spectrum of possible colors by combining light with different colors and different intensities.

Figure 3:
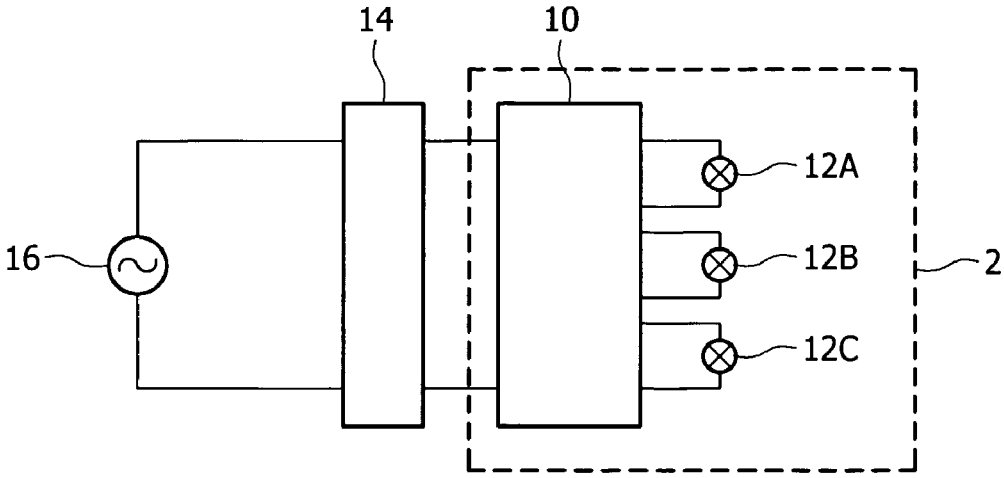
FIG. 3 shows a block diagram of an electrical installation for operation of a color adjustable lamp according to the present invention.

FIG. 3 illustrates a diagram of an electrical circuit comprising a lamp 2 according to the present invention. The lamp 2 comprises three light sources 12A, 12B, and 12C. The light sources 12A, 12B, and 12C are controlled and driven by a lamp driving circuit 10. The circuit further comprises a well-known TRIAC dimming circuit 14 and an alternating voltage source 16 such as a mains voltage.

Figure 4:
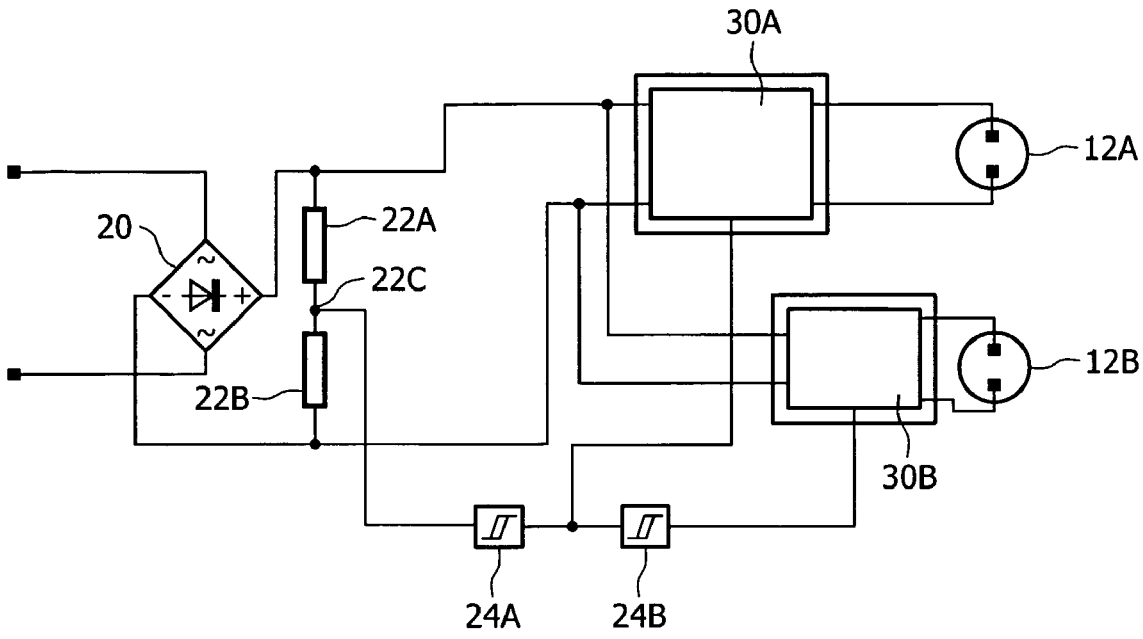
FIG. 4 shows an electrical diagram of an embodiment of a lamp driving circuit according to the present invention.

A lamp driving circuit 10 for driving two light sources 12A and 12B is shown in FIG. 4 in more detail. The driving circuit 10 comprises a rectifier circuit 20 for rectifying an alternating input voltage. The rectified voltage output by the rectifier circuit 20 is supplied to a first lamp ballast circuit 30A and to a second lamp ballast circuit 30B. Further, a voltage divider circuit comprising a first resistor 22A and a second resistor 22B. The voltage at a node 22C between the resistors 22A and 22B has an identical shape as the rectified voltage output by the rectifier circuit 20, but has a lower voltage level.

The voltage at node 22C is supplied to a first Schmitt trigger circuit 24A. The output of the first Schmitt trigger circuit 24A is supplied to the first lamp ballast circuit 30A and to a second Schmitt trigger circuit 24B. The output of the second Schmitt trigger circuit 24B is supplied to the second lamp ballast circuit 30B.

Figure 5:
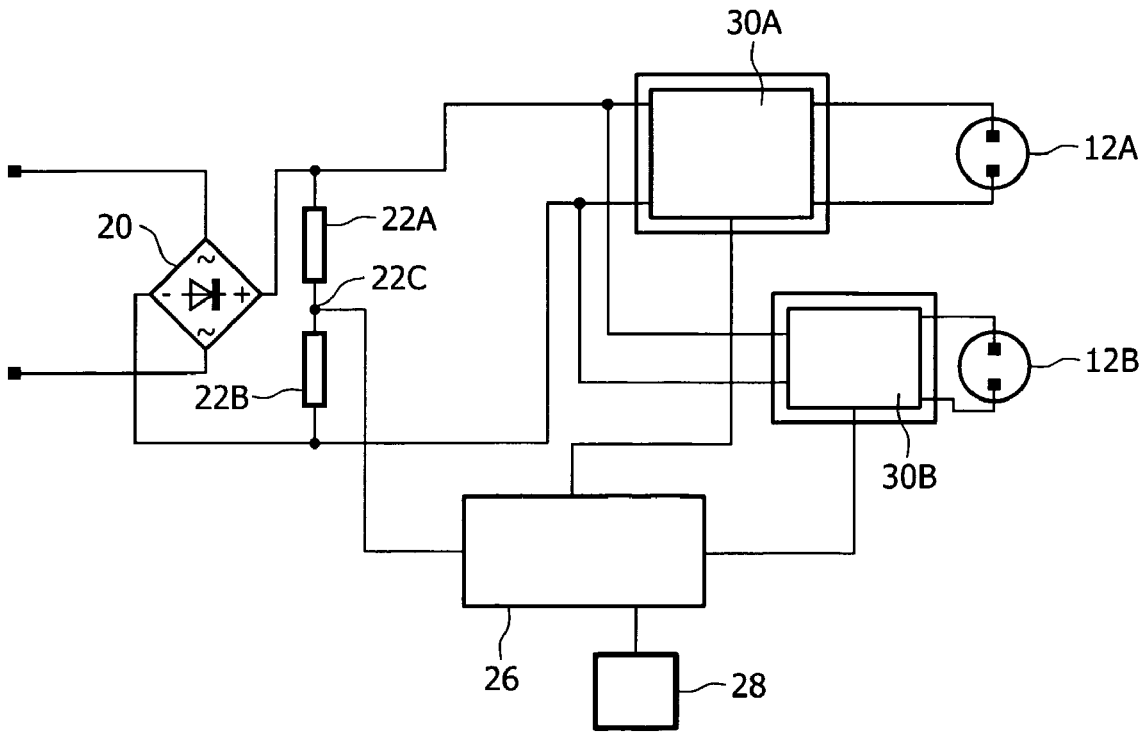
FIG. 5 shows an electrical diagram of another embodiment of a lamp driving circuit according to the present invention.

FIG. 5 shows a similar driving circuit 10. However, compared to the circuit shown in FIG. 4, the circuit 10 of FIG. 5 comprises a processing unit 26 instead of two Schmitt trigger circuits. The processing unit 26 is coupled to a memory unit 28. The memory unit 28 stores data, e.g. a look-up table or an algorithm, indicating a setting for each light source 12A, 12B for outputting light having a desired color. The processing unit 26 receives the rectified voltage output by the rectifier circuit 20, and determines the shape of the voltage. Then, the processing unit 26 may access the memory unit 28 to obtain the setting for each light source 12A, 12B corresponding to said shape.

It is noted that the memory unit 28 and the processing unit 26 may be incorporated in one (e.g. semiconductor) device. Further, if the shape of the voltage is processed by an algorithm to obtain the setting of each light source 12A, 12B as mentioned above, said algorithm may be embedded in the processing unit 26 and the memory unit 28 may be omitted.

The embodiment of FIG. 4 is especially suitable for use in combination with a TRIAC dimmer circuit due to the use of Schmitt trigger circuits. The embodiment of FIG. 5 may be employed in combination with any voltage shaping circuit, since the processing unit 26 may be configured to determine a shape of virtually any varying voltage.

In the circuits of FIG. 3 and FIG. 4, an alternating voltage source 16, such as a mains voltage supply, is connected to a TRIAC dimmer circuit 14. The alternating voltage supplied by the voltage source 16 is presumed to be sine wave shaped. However, another shape may as well be employed, if the lamp driving circuit 10 is configured accordingly.

The TRIAC dimmer circuit 14 changes the shape of the alternating voltage depending on a setting of a variable resistor. The TRIAC dimmer circuit 14 is a well-known circuit and is not described in more detail here. The TRIAC dimmer circuit 14 changes a sine wave shaped voltage such that the output voltage is kept substantially zero as long as the sine wave shaped input voltage is below a predetermined level. The variable resistor may determine said level. Thus, after a zero crossing of the alternating voltage, the TRIAC dimmer circuit 14 does not conduct and blocks the input voltage.

After the alternating input voltage has increased to a level above the predetermined level, the TRIAC dimmer circuit 14 conducts the input voltage, and the output voltage is substantially identical to the input voltage. As soon as the input voltage reaches its next zero crossing, the TRIAC dimmer circuit 14 blocks the input voltage again. Thus, during a first part of each half period of the sine wave the output voltage is zero. At a predetermined phase angle of the sine wave, the output voltage substantially instantaneously switches to a level corresponding to said sine wave input voltage.

A TRIAC dimmer circuit may be employed as the phase angle dimmer circuit 14, but also other circuits may function as the phase angle dimmer circuit 14 for controlling the color adjustable lamp. However, it is not essential to the present invention that a phase angle dimmer circuit is used. Other kind of circuits shaping an alternating voltage may as well be employed. The shape of the voltage essentially should be periodically determinable, i.e. the shape of the voltage is periodic and for each period at least one characteristic of the voltage may be determined for detecting a setting of a user interface, such as the variable resistor of a TRIAC dimmer circuit.

The TRIAC dimmer circuit output voltage is rectified by the rectifier circuit 20 resulting in a half sine wave voltage. Such a rectified voltage may be advantageously supplied to the lamp ballast circuits 30A and 30B, since they may require a rectified voltage for operating the coupled light source 12A or 12B, respectively. Thus, the lamp ballast circuits 30A and 30B and the corresponding light sources 12A and 12B are provided with a suitable light source supply voltage.

Each lamp ballast circuit 30A and 30B is provided with an input node for switching the coupled light source 12A, 12B on or off. The rectified voltage is also input in a voltage divider circuit comprising the first resistor 22A and the second resistor 22B, creating a voltage at node 22C that has the same shape, but with a lower level. The voltage at node 22C is input in a Schmitt trigger circuit. In casu, the Schmitt trigger circuit 24 outputs a low voltage when the input voltage is above a predetermined voltage and a high voltage when the input voltage is below said predetermined voltage. Inputting a sine wave results in a square wave output. The duty cycle of the square wave, i.e. the length of the period the square wave is high with respect to the length of one period of the square wave, depends on the shape of the input voltage and the predetermined voltage.

When the output of the first Schmitt trigger circuit 24A is high, the lamp ballast circuit 30A is switched on. The Schmitt trigger circuit 24B outputs a low voltage due to the high output voltage of the first Schmitt trigger device 24A and thus switches lamp ballast circuit 30B off. Therefore, when the first light source 12A is on, the second light source 12B is off, and the other way round. The duty cycle of the square wave determines the period during which the first light source 12A is on and the period during which the second light source 12B is on.

The duty cycle of the square wave voltages output by the Schmitt trigger circuits 24A and 24B depends on the phase angle of the supplied alternating voltage set by the phase angle dimmer circuit 14. Depending on said duty cycle the first light source 12A emits an amount of light having a first color and the second light source 12A emits an amount of light having a second color. The total light emitted by the two light sources 12A and 12B may thus have a color that is set by adjusting the intensity of the light emitted by each light source 12A and 12B.

In the above described embodiment using two Schmitt trigger circuits 24A and 24B, at any moment one of the two light sources 12A, 12B is on and the other is off. However, in another embodiment, the light sources 12A and 12B may be on and off simultaneously. The lamp driving circuit embodiment illustrated in FIG. 5 may be employed in such an embodiment.

In the circuit illustrated in FIG. 5 the input alternating voltage being shaped by a shape changing circuit, such as a phase angle dimmer circuit, is rectified and supplied to each light source 12A and 12B. In this embodiment, the voltage at node 22C is supplied to the processing unit 26. The processing unit 26 is configured to determine the shape of the supplied voltage. The processing unit 26 may input the shape in an algorithm or may access the memory unit 28, and data stored therein, to determine a desired light output intensity for each light source 12A and 12B. Corresponding to said determined desired light output intensity, the processing unit 26 controls each lamp ballast circuit 30A and 30B in order to output light having the desired color.

Figure 6A:
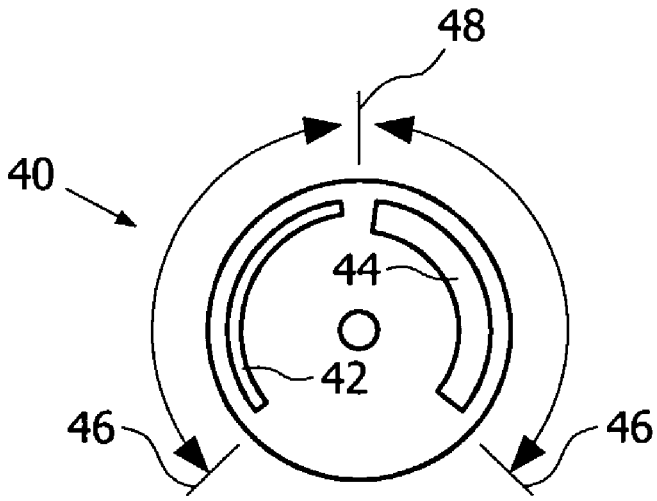
FIG. 6A shows an embodiment of a control knob for adjusting the color and intensity of a lamp according to the present invention.
Figure 6B:
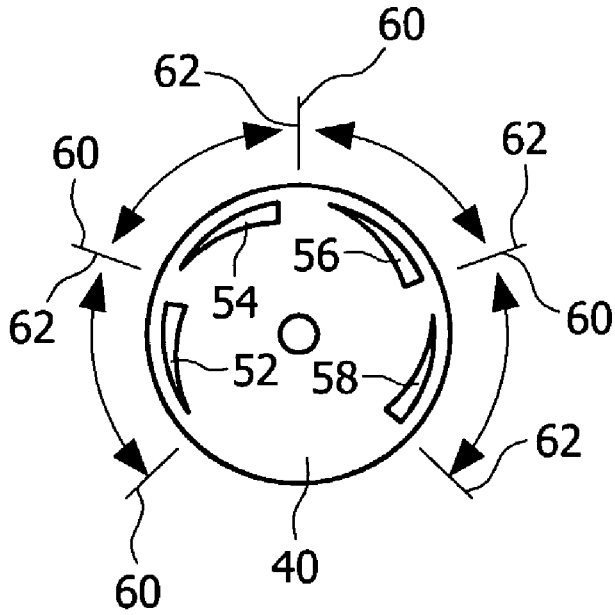
FIG. 6B shows another embodiment of a control knob for adjusting the color and intensity of a lamp according to the present invention.

FIGS. 6A and 6B illustrate two possible user-interface knobs 40 for controlling a color adjustable lamp according to the present invention. Both user-interface knobs 40 may control a variable resistor of a TRIAC dimmer circuit, thereby shaping the output voltage.

The user interface of FIG. 6A shows two ranges 42 and 44. Each range 42, 44 runs from a first color 46 to a second color 48. The first range 42 outputs light having a first predetermined total intensity, the second range 44 outputs light with a second predetermined total intensity. The second intensity 44 may be twice the first predetermined intensity 42, for example.

The user interface of FIG. 6B shows four ranges 52, 54, 56 and 58. Each range runs from a first light intensity 60 to a second light intensity 62, for example from 25% to 100% of the maximum light output intensity. Each range outputs light having a predetermined color.

The user-interface knobs 40 of FIGS. 6A and 6B are suitable for use in combination with the driving circuit of FIG. 5 rather than in combination with the driving circuit of FIG. 4. Using the illustrated user interfaces the output light may be set with respect to two parameters: intensity and color. The setting of the user interface by setting a variable resistor however changes only one parameter of the voltage. Using a processing unit and possibly a memory unit, said one parameter may be used to determine a setting for two parameters, for example by accessing a table comprising preset parameters for each state of the user-interface knob.

It is noted that in the described and illustrated embodiments, if no voltage shaping circuit is employed, the color adjustable lamp may still function correctly. The shape of the supplied voltage may then be detected as a sine wave, if coupled to a mains voltage supply for example, and the output may be determined accordingly. In the embodiment of FIG. 4, this may result in light source 12A outputting light at full power during half a period, while light source 12B may be switched on during another half of said period. Thus, the color adjustable lamp may be employed in an existing electrical circuit for replacing a common incandescent lamp, although not all functionality of the color adjustable lamp may be available in such a case.

In the above description as well as in the appended claims, 'comprising' is to be understood as not excluding other elements or steps and 'a' or 'an' does not exclude a plurality. Further, any reference signs in the claims shall not be construed as limiting the scope of the invention.

The invention claimed is:

1. Color adjustable lamp comprising at least two light sources for emitting light having a different color and a lamp driving circuit for receiving a varying supply voltage and for controlling the light sources, wherein the lamp driving circuit is configured to control a color of the light emitted by the lamp on the basis of a shape of the supply voltage and comprises:

a ballast control circuit configured to receive the varying supply voltage and to output a lamp control signal for each light source corresponding to the shape of the supply voltage; and a lamp ballast circuit for each of the at least two light sources, each lamp ballast circuit being configured to receive said rectified supply voltage and said corresponding lamp control signal for outputting a light source supply voltage corresponding to said lamp control signal in order to control the light intensity of each light source.

2. Color adjustable lamp according to claim 1, wherein the lamp driving circuit is further configured to control a light intensity of each of the at least two light sources on the basis of the shape of the supply voltage.

3. Color adjustable lamp according to claim 1, wherein the lamp driving circuit comprises a rectifier circuit for rectifying an alternating voltage and outputting said varying supply voltage.

4. Color adjustable lamp according to claim 1, wherein the lamp driving circuit is further configured to control a total intensity of the light emitted by the lamp on the basis of the shape of the supply voltage.

5. Color adjustable lamp according to claim 1, wherein the ballast control circuit comprises a Schmitt trigger circuit for converting the varying supply voltage to a square wave voltage as said lamp control signal, a pulse width of said square wave being determined by the shape of the supply voltage, the lamp ballast circuit determining each light source supply voltage according to the pulse width of the square wave voltage.

6. Color adjustable lamp according to claim 1, wherein the ballast control circuit comprises a processor for determining the lamp control signal for each lamp ballast circuit according to the shape of the supply voltage and a predetermined algorithm, and for outputting said lamp control signal to each lamp ballast circuit.

7. Color adjustable lamp according to claim 1, wherein the ballast control circuit comprises a processor and a memory, in which a look-up table is stored, said processor determining the lamp control signal for each light source according to the shape of the supply voltage and the look-up table stored in said memory, and for outputting said lamp control signal to each ballast circuit.

8. Method for controlling a color adjustable lamp, the lamp comprising at least two light sources, each light source being configured to emit light with a different color, the method comprising:

supplying a varying supply voltage to the lamp, setting a shape of the varying supply voltage, determining the shape of the supply voltage, and setting a light intensity of each of the at least two light sources according to the shape of the supply voltage.

9. Method for controlling a color adjustable lamp according to claim 8, wherein the shape of the varying supply voltage is set by setting a phase angle of a TRIAC.

* * * * *